United States Patent [19]

Herrick

[11] Patent Number: 4,998,187

[45] Date of Patent: Mar. 5, 1991

[54] HEADLAMP HOLDER DEVICE

[76] Inventor: Peter W. Herrick, 21 Taylor St., Salem, N.H. 03079

[21] Appl. No.: 484,275

[22] Filed: Feb. 6, 1990

[51] Int. Cl.[5] ..... F21L 15/14

[52] U.S. Cl. ..... 362/103; 362/105; 362/190

[58] Field of Search ..... 362/103, 104, 105, 106, 362/190, 191

[56] References Cited

U.S. PATENT DOCUMENTS

| | | | |
|---|---|---|---|
| 2,421,643 | 6/1947 | Ostli | 362/106 |
| 4,195,328 | 3/1980 | Harris, Jr. | 362/106 |
| 4,631,644 | 12/1986 | Dannhauer | 362/103 |
| 4,734,834 | 3/1988 | Petzl et al. | 362/103 |

*Primary Examiner*—Allen M. Ostrager
*Assistant Examiner*—Sue Hagarman
*Attorney, Agent, or Firm*—Edward A. Gordon

[57] ABSTRACT

A headlamp holder device for use with a user's helmet having an outer generally convex shape including a base member having an upper surface and a lower surface having a generally concave curvature so as to conform to at least a portion of the convex outer surface of the user's helmet; an upper member having a pair of opposing support members extending outwardly and upwardly in a lateral direction to the base member providing a support for mounting a conventional underwater self-powered flashlight thereon. The upper member includes a strap for releasably attaching the flashlight on the upper member. The upper member is pivotally attached to the base member so that the light beam of the flashlight is selectively adjustable in a forward vertical arc direction by the user. The headlamp holder device also includes fasteners for releasably attaching the base member to the user's helmet. In a preferred embodiment the headlamp holder device is formed of a lightweight rigid plastic material.

2 Claims, 2 Drawing Sheets

HEADLAMP HOLDER DEVICE

BACKGROUND OF THE INVENTION

1. Field of the Invention

The present invention relates in general to flashlight holders and more particularly to a new and improved headlamp holding device which incorporates a detachable self-powered flashlight and may be mounted to the helmet of the user such as the hood of an underwater diver.

2. Description of the Prior Art

Headlamps are useful in situations where temporary illumination is required and both hands must be free. Head mounted lamps have been used for many years in the field of mining for illuminating the work area of the miner. Furthermore, helmets have been provided with lighting systems to be used by under water divers such as scuba divers. While many designs for headlamps exist in the prior art, there still exists a need for a headlamp holder for underwater use which utilizes existing underwater flashlights as a detachable light source.

The present state of the art is believed to be exemplified in the following U.S. Patents:

| | |
|---|---|
| 2,421,643 | 4,462,064 |
| 3,852,587 | 4,638,410 |

Accordingly, a principle desirable object of the present invention is to overcome the disadvantages of the prior art.

Another desirable object of the present invention is to provide a new and improved headlamp holder for underwater use which utilizes existing underwater type flashlights as a detachable light source.

Another desirable object of the present invention is to provide a headlamp holder device which is easily mounted on the headpiece, such as a helmet or hood of the user.

Another desirable object of the present invention is to provide an improved headlamp device which is constructed and arranged whereby the light beam of the flashlight employed is adjustable in a forward vertical arc direction.

A still further desirable object of the present invention is to achieve the above desirable objects with an essentially simple structure lending itself to inexpensive mass production, These and other desirable objects of the present invention will in part appear hereinafter and will in part become apparent after consideration of the specification with reference to the drawings and the claims.

SUMMARY OF THE INVENTION

The present invention discloses a new and improved headlamp holder device for use with a user's helmet having an outer generally convex shape. The headlamp holder device includes a base member having an upper surface and a lower surface, the lower surface having a generally concave curvature extending forwardly and rearwardly so as to conform to at least a portion of the convex outer surface of the user's helmet or hood; fastener means for releasably attaching the base member to the user's helmet; and an upper member having a pair of opposing support members extending outwardly and upwardly in a lateral direction to the base member. The opposing support members provide support for mounting a self-powered flashlight thereon. The headlamp holder device includes attaching means for releasably attaching the flashlight on the support members. Pivotal means are provided for attaching the upper member to the base member to provide for adjustment of the light beam of the flashlight in forward vertical arc direction.

BRIEF DESCRIPTION OF THE DRAWINGS

For a fuller understanding of the nature and desired objects of the present invention, reference should be had to the following detailed description taken in connection with the accompanying drawings wherein like reference characters denote corresponding parts throughout the several views and wherein:

FIG. 1 is a bottom view of the headlamp holder device of FIG. 1;

DETAILED DESCRIPTION OF PREFERRED EMBODIMENT(S)

Figure 1:
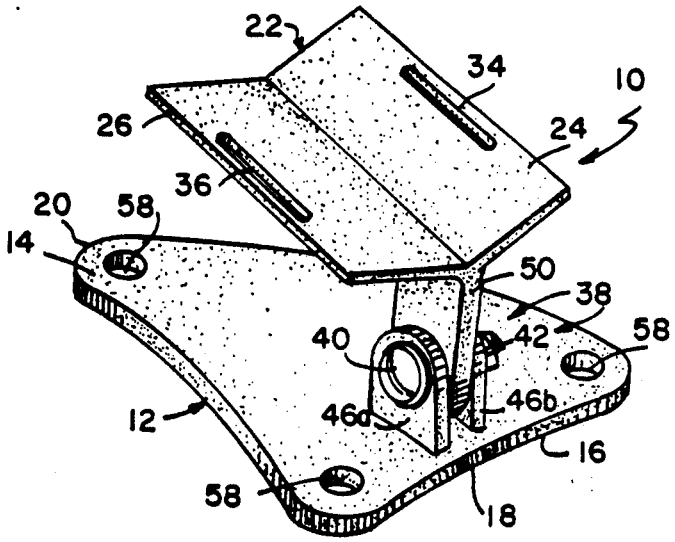
FIG. 1 is an enlarged perspective view of a headlamp holder device embodying the principles of the present invention.
Figure 1A:
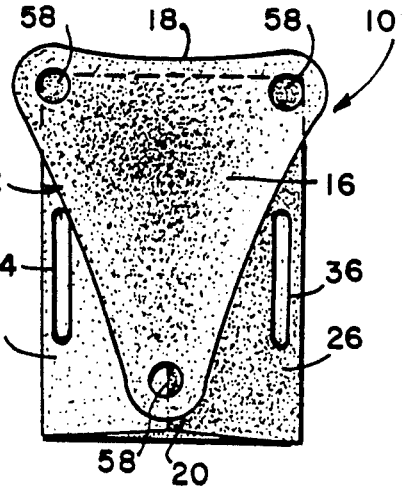
Figure 2:
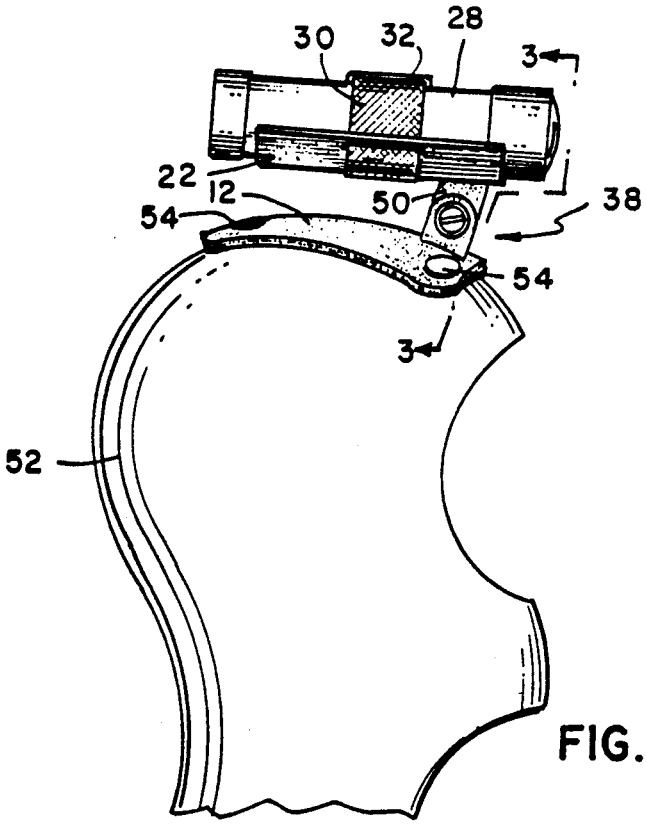
FIG. 2 is a side elevational view of a headlamp holder device of the present invention mounted on the hood of an underwater diver and having a self-powered flashlight attached to the holder device.
Figure 3:
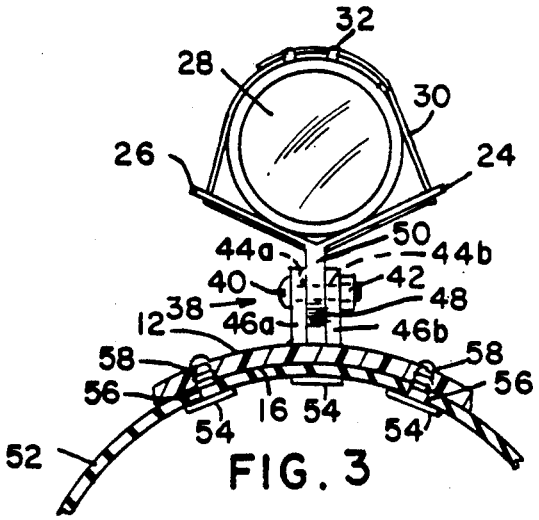
FIG. 3 is an enlarged front view having a partial transverse sectional view taken along the line 3—3 of FIG. 2.

Referring now to the drawings and more particularly to FIGS. 1–4, the headlamp holder device embodying the principles of the present invention is illustrated generally by the reference numeral 10. The headlamp holder device 10 includes a base member 12 having an upper surface 14 and a lower surface 16. The lower surface 16 is provided with a generally concave curvature extending from the forward edge or portion 18 to the rearward portion or edge 20 of the base member 12. The base member 12 is preferably provided with a generally triangular configuration (as best seen in FIGS. 1 and IA) which tapers in width from the forward portion 18 to the rearward portion 20. While the present invention contemplates other configurations such as squares, rectangles, circles and elliptical configurations, it was discovered that the triangular configuration with a concave lower surface maximizes support when attached to the user's helmet or hood, for example, while minimizing cost of manufacture. The headlamp holder 10 also includes an upper member 22 which comprises a pair of opposing support members 24 and 26 which extend upwardly and outwardly in a lateral direction with respect to the base member 12 in the form of a longitudinal V-shaped configuration. It is to be understood that while the present invention contemplates other configurations for the upper member such as a U-shape or rectangular shape, the V-shape which runs lengthwise provides a suitable support surface for self-powered flashlight members having various configurations, while simplifying manufacturing thereof. As shown in FIGS. 2 and 3 a self-powered flashlight member 28 having a generally longitudinal circular configuration is attached upon the upper member 22 by a strap member 30 having a buckle member 32. The support members 24 and 26 are provided with strap apertures 34 and 36 through which the strap member 30 is inserted and passed through to secure the strap member 30 including the flashlight member 28 to the upper member 22. The strap member 30 serves as a fastening means for releasably attaching the flashlight member 28 to the upper member 22.

The upper member 22 is pivotally attached to the base member 12 by pivotal means indicated generally by the reference numeral 38. The pivotal means 38 is in the form of a bolt member 40 and associated nut member 42. The bolt member 40 extends through the apertures **44*a* and 44*b* disposed in the spaced adjacent side arm members 46*a* and 46*b* attached to the base member 12, and the aperture 48 disposed in the middle arm member 50 which is attached to the bottom surface of the upper member 22 and positioned between the side arm members 46*a* and 46*b***.

Figure 4:
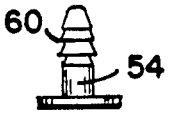
FIG. 4 is an enlarged side plan view of an attaching member employed in FIGS. 2 and 3 for attaching the holder to the user's hood.

Referring now more particularly to FIGS. 2–4, the headlamp holder device 10 is mounted or attached to the hood 52 of the user by fastener means such as, for example, by three conventional ratchet fasteners 54, which are inserted from within the hood member 52 through the aperture 56 in the hood member and the aperture 58 in the base member 12 of the headlamp holder device 10. The relative size of the apertures 56 and 58 and the circumference of the rib members 60 of the ratchet fastener are selected so that the circumference of the rib member 60 is slightly larger than the circumference of the apertures 56 and 58 so that the ratchet fastener when forced through the aperture of the hood and base member securely attach the hood member 52 to the base member. The ratchet fasteners 54 are preferably formed of a lightweight rigid plastic material such as PVC or ABS plastic.

Figure 5:
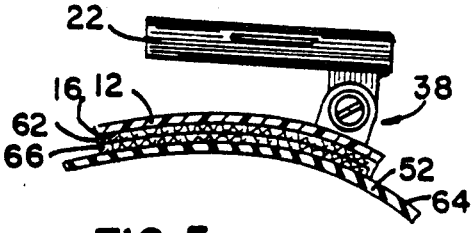
FIG. 5 is a fragmentary side view partially in section illustrating a headlamp holder device in accordance with the present invention attached to the hood of an underwater diver by mating VELCRO strips.

Referring now to FIG. 5, there is illustrated an alternative fastening means for releasably attaching the base member 12 of the headlamp holder device 10 to the hood member 52. In this embodiment the base member 12 is releasably attached to the hood member 52 by VELCRO mating material such as mating hook and loop piles whereby the lower surface 16 of the base member 12 is covered with VELCRO material 62 of one type and a corresponding area of the outer surface 64 of the hood member 52 is covered with VELCRO material 66 of the mating or opposite type. Also it should be noted that other equivalent attachment means may be used to attach the base member to the hood or helmet of the user such as, for example, adhesives, conventional snap in devices, etc.

Figure 6:
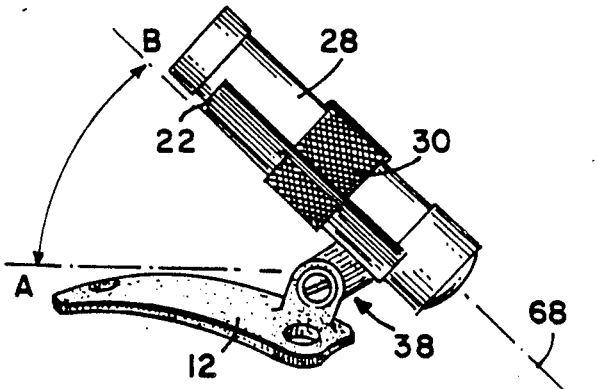
FIG. 6 is a side view of a headlamp holder of the present invention with a flashlight mounted thereon and shown pivoted in a downwardly oriented position.
Figure 7:
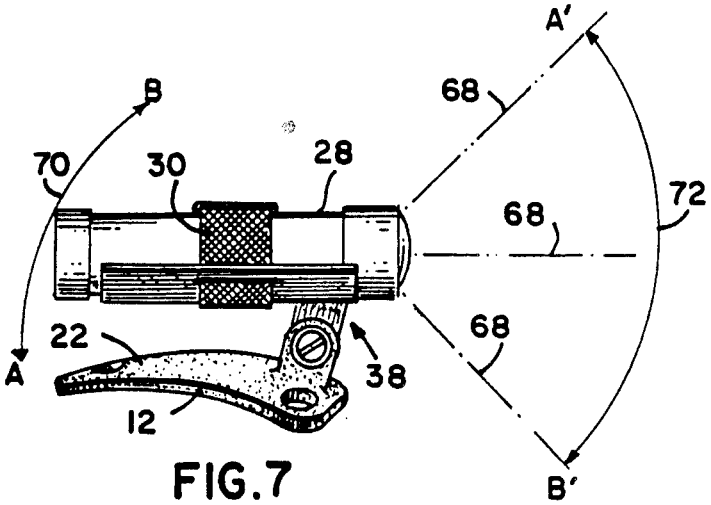
FIG. 7 is a side view of the headlamp holder of FIG. 6 illustrating the pivotal movement of the upper member to adjust the light beam of the flashlight in a forward vertical arc direction.

Referring now to FIGS. 6 and 7, the pivotal feature of the headlamp holder device is illustrated. In FIG. 6 the rear portion 20 of the upper member 22 of the headlamp holder device is pivoted upwardly from the low position A to the upper position B whereby the light beam indicated by the dotted line 68 is oriented in a downward position with respect to the horizontal plane. FIG. 7 illustrates the pivotal range of the upper member. As shown, pivoting of the rear portion 20 from the low position A upwardly through the arc to the position B results in vertical orientation of the light beam 68 through the vertical arc 72 from the upper position A′ through to the lower position B′ thereby permitting the user to direct the light beam by pivoting the upper member 22 to the appropriate desired position.

The headlamp holder device of the present invention may be constructed of plastic, wood, metal or combinations thereof. In a preferred embodiment, the headlamp holder device is formed or molded of a suitable lightweight rigid plastic such as polyvinylchloride (PVC) or acrylonitrile butadiene styrene (ABS) plastic.

The strap member 30 may be formed of flexible plastic or stretch resistant rubber material.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A headlamp holder device formed of a lightweight rigid plastic material for use with a flexible diver's helmet having an outer generally convex shape corresponding with the heads of the users, said headlamp holder device comprising:

a base member having an upper surface and a lower surface forming a forward portion and a rearward portion;

said lower surface having a generally concave curvature adapted to conform to at least a portion of the convex outer surface of user's helmet worn on the user's head;

said base member tapering rearwardly in width from the forward portion to the rearward portion and defining a plurality of apertures disposed about the periphery of the base member and adapted to receive fastener means;

a plurality of ratchet fastener means adapted to extend upwardly through the diver's helmet and the apertures of the base member thereby attaching the base member to the user's helmet;

an upper longitudinally extending member having a pair of laterally extending members having a V-shaped cross section providing a support for mounting a self-powered flashlight member thereon;

said upper member including attaching means for releasably attaching the self-powered flashlight member on said upper V-shaped member comprising apertures defined by each of said laterally extending members for receiving a strap loop means and a strap loop means for attachment of a self-powered flashlight member on said lateral extending V-shaped members; and pivotal means attaching said upper member to said base member whereby the light beam of the self-powered flashlight member is adjustable in a forward vertical arc direction.

2. The headlamp holder device according to claim 1 wherein the base member tapers in width rearwardly.

* * * * *